United States Patent [19]

Johnson

[11] Patent Number: 4,686,607

[45] Date of Patent: Aug. 11, 1987

[54] DAUGHTER BOARD/BACKPLANE ASSEMBLY

[75] Inventor: Lennart B. Johnson, Milford, N.H.

[73] Assignee: Teradyne, Inc., Boston, Mass.

[21] Appl. No.: 817,013

[22] Filed: Jan. 8, 1986

[51] Int. Cl.[4] ..... H01R 23/68

[52] U.S. Cl. ..... 361/413; 339/17 C; 339/17 LC; 339/17 LM; 339/17 M; 361/401; 361/412

[58] Field of Search ..... 361/400–401, 361/412–415; 339/17 LC, 17 C, 17 LM, 17 M; 357/80

[56] References Cited

U.S. PATENT DOCUMENTS

| | | | |
|---|---|---|---|
| 2,701,346 | 2/1955 | Powell | 361/413 X |
| 2,925,537 | 2/1960 | Winkler | 339/17 LM |
| 4,076,356 | 2/1978 | Tamburro | 339/17 C |
| 4,418,972 | 12/1983 | Benasutti | 339/17 LM X |
| 4,482,937 | 11/1984 | Berg | 361/413 |
| 4,514,784 | 4/1985 | Williams et al. | 339/17 M X |

FOREIGN PATENT DOCUMENTS

| | | | |
|---|---|---|---|
| 2034126 | 5/1980 | United Kingdom | 361/413 |

OTHER PUBLICATIONS

Martyak, J. E., Natoli, T. N., Ricci, R., "Connector-Interposes for Module-to-Board Connection", JBM Tech Disc., vol. 14, No. 8 1/72, p. 2297.

Brauslau, N., Keyes, R. W. "Pkg for High Speed Ckts; IBM Tech. Discl. Bul., vol 20, No. 11B 4/78, pp. 4975–4976.

Teradyne, "P.C. Backplane Connectors", Tech. Bul., No. 237, Jan. 29, 1985, pp. 9–10.

*Primary Examiner*—A. T. Grimley

*Assistant Examiner*—Jane K. Lau

[57] ABSTRACT

A daughter board/backplane assembly including a backplane having first and second surfaces and holes extending from the first surface to the second surface, pairs of separate first contacts having first ends mounted in the holes and second ends extending from both ends of the holes, the second ends of each first contact being positioned with respect to the respective surface from which it extends, and a plurality of daughter boards mounted on opposite sides of the backplane and carrying second contacts mating with the second ends of the first contacts.

7 Claims, 1 Drawing Figure

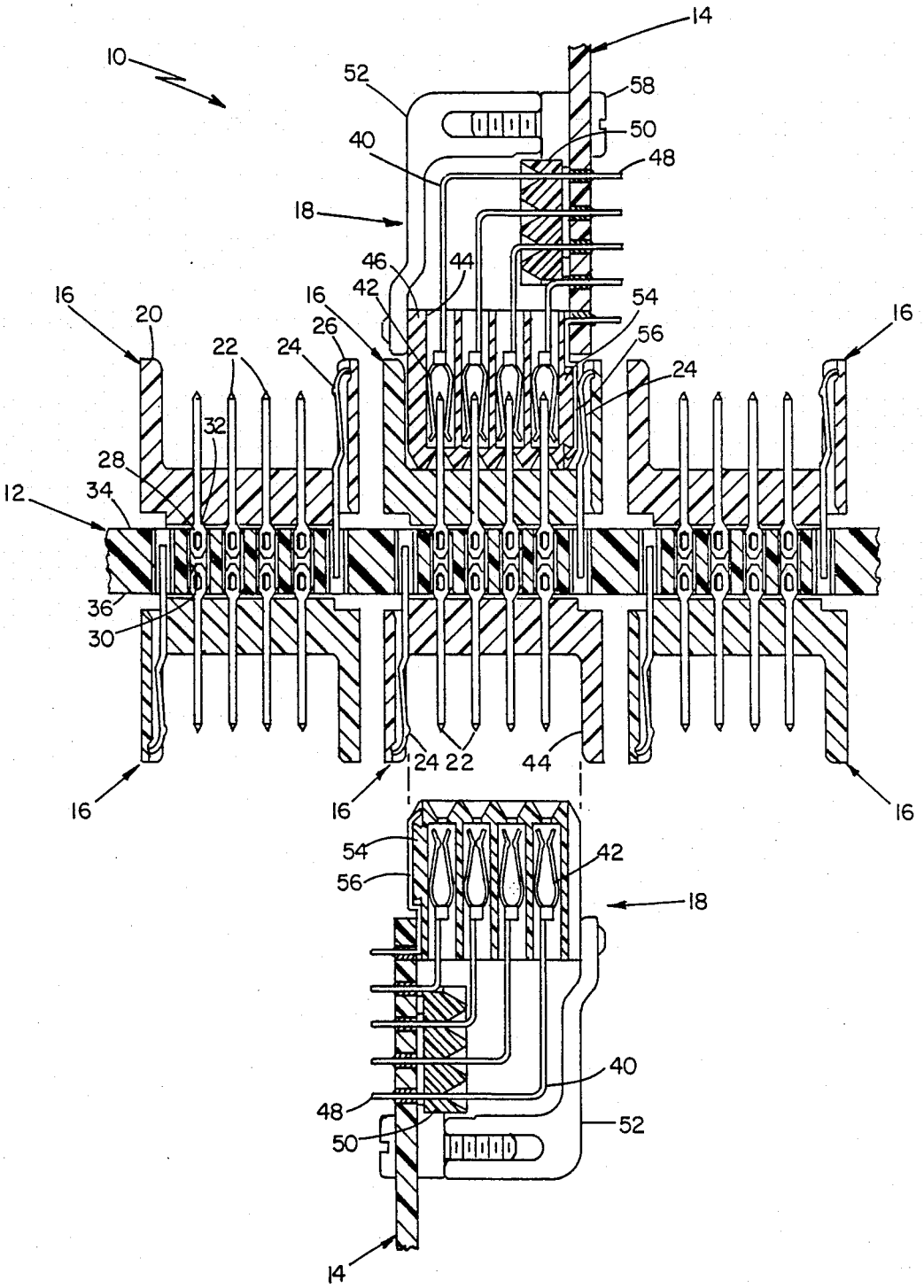
10
14
52
58
50
40
48
18
46
44
42
16
20
16
26
54
56
22
24
24
16
32
28
12
34
36
30
24 22
44
16
16
16
54
42
56
18
40
48
52
50
14

DAUGHTER BOARD/BACKPLANE ASSEMBLY

FIELD OF THE INVENTION

The invention relates to daughter board/backplane connection systems.

BACKGROUND OF THE INVENTION

A plurality of daughter boards are often detachably mounted on one side of a backplane and electrically connected to each other through pin contacts mounted in the backplane and electrically connected to other pin contacts via conductive paths incorporated in the backplane or wires or bus bars connected between wire wrap portions of the pin contacts extending underneath the backplane.

As rise times for electronic signals between components and data processing time continue to decrease, the distance a signal has to travel from one daughter board to another is becoming a more critical consideration. Prior to the invention claimed herein, someone who was not obligated to assign rights to the assignee of this application suggested mounting daughter boards on opposite sides of a backplane to provide shorter paths between components on different boards.

SUMMARY OF THE INVENTION

I have discovered that in providing a connection system for daughter boards mounted on both sides of a backplane, I could advantageously use pairs of separate contacts mounted in common holes through the backplane so that the portions of the contacts extending from the opposite sides of the backplane could be accurately and independently positioned with reference to the surfaces from which they extend regardless of the backplane thickness and still provide good high-speed electrical transmission.

In preferred embodiments the contacts extending from the backplane are pin contacts having expanded portions that are press fit into plated-through holes in the backplane; the pin contacts have shoulders between the expanded portions and the ends extending from the backplane; and a plastic backplane connector element supports a plurality of rows of the pin contacts and has upstanding sidewalls for engaging a mating daughter board connecting element with a corresponding plurality of mating contacts.

Other advantages and features of the invention will be apparent from the following description of a preferred embodiment thereof and from the claims.

DESCRIPTION OF THE PREFERRED EMBODIMENT

DRAWING

The drawing is a diagrammatic vertical sectional view showing a daughter board/backplane assembly, partially disconnected, according to the invention.

STRUCTURE

Referring to the drawing, there is shown daughter board/backplane assembly 10 including backplane 12 and daughter boards 14 electrically connected to each other through backplane connector elements 16 and daughter board connector elements 18. Backplane connector elements 16 include plastic housing 20 and four rows of pin contacts 22 mounted in the base of housing 20 and extending away from the backplane. Backplane connector element 16 also includes fifth row contacts

24, which are carried by sidewall 26 and are used for ground or voltage. Each pin contact 22 has a lower end with expanded portion 28 that is press fit into a plated-through hole 30 of backplane 12. The length of each expanded portion 28 is less than one-half of the thickness of backplane 12, to permit a pair of pin contacts 22 to share a common hole 30. Pin contacts 22 have shoulders 32, to accurately position pin contacts 22 with respect to housings 20 and either upper surface 34 or lower surface 36 of backplane 12.

Daughter board connector element 18 includes contacts 40 that are forked at ends 42 in boxes 44 of plastic housing 46 and are bent horizontally at the other ends 48, which pass through plastic guide board 50 and holes in daughter board 14, where they are soldered. Aluminum stiffener 52 is connected between guide board 50 and housing 46 to cover exposed portions of contacts 40 and provide structure to daughter board connector element 18. On the outer face of sidewall 54 of housing 46 are fifth row ground contacts 56, mating with fifth row contacts 24 of the backplane connector element.

In manufacture, pin contacts 22 are first inserted into plastic housing 20 until shoulders 32 contact the lower surface of housing 20. A loading head is placed over the pointed ends of pin contacts 22, and the expanded portions 28 are pushed into holes 30, the loading head pushing against the tips of pin contacts 22 and against shoulders 32 (through housing 20) until the lower surface of housing 20 touches upper surface 34 or lower surface 36 of backplane 12. The expanded portions of contacts 24, not seen in the FIGURE owing to their orientation, are similarly press-fit into respective plated-through holes.

In making connection through the backplane, the goal of minimizing the number of connections in order to improve electrical transmission would indicate using a single pin passing through each hole, particularly in light of the desire to reduce distortions caused at connection points in the increasingly higher speed designs; accurate location of both ends of single pins would be difficult, and would require precise backplane thickness. By using two pin contacts 22 in the same hole, they are independently precisely located with respect to upper surface 34 and lower surface 36, regardless of the thickness of backplane 12, the tolerance for which might be as much as 0.030" WITH A 0.180" thick backplane, and good high speed electrical transmission is still provided.

OPERATION

Operation of daughter board/backplane assembly 10 is as usual, daughter board connector elements 18 being inserted into backplane connector elements 16 to electrically connect daughter boards 14.

OTHER EMBODIMENTS

Other embodiments of the invention are within the scope of the following claims.

What is claimed is:

1. A daughter board/backplane assembly comprising a backplane having first and second surfaces and holes extending from said first surface to said second surface, pairs of separate first contacts having first ends mounted in said holes and second ends extending from opposite ends of said holes, each said contact of a pair extending from opposite ends of the same hole, each said second end being positioned with respect to the respective surface from which it extends, and a plurality of daughter boards mounted on opposite sides of said backplane and carrying second contacts mating with said second ends of said first contacts extending from both said first and second surfaces.

2. The assembly of claim 1 wherein said holes through said backplane are plated-through holes.

3. The assembly of claim 2 wherein said first ends of said first contacts are expanded hollow portions that are press fit into said holes.

4. The assembly of claim 3 wherein there is a shoulder between said first end and said second end of each said first contact.

5. The assembly of claim 4 further comprising a backplane connector element that is made of insulating material, engages a plurality of first contacts, and has sidewalls extending generally parallel to said first contacts, and wherein said shoulders touch a lower surface of said backplane connector element, and said daughter boards have daughter board connector elements designed to mate with said first sidewalls of said backplane connector element.

6. The assembly of claim 1 futher comprising a backplane connector element that is made of insulating material, engages a plurality of said first contacts and has sidewalls extending generally parallel to said first contacts, and said daughter boards have daughter board connector elements designed to mate with said sidewalls of said backplane connector element.

7. The assembly of claim 6 wherein said first contacts have second ends that are pins, and said second contacts are forks designed to mate with said pins.

* * * * *